US009042789B2

(12) United States Patent
Tanio

(10) Patent No.: US 9,042,789 B2
(45) Date of Patent: May 26, 2015

(54) TONER CASE AND IMAGE FORMING APPARATUS

(71) Applicant: KYOCERA DOCUMENT SOLUTIONS INC., Osaka (JP)

(72) Inventor: Koji Tanio, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 47 days.

(21) Appl. No.: 13/897,211

(22) Filed: May 17, 2013

(65) Prior Publication Data

US 2013/0315633 A1 Nov. 28, 2013

(30) Foreign Application Priority Data

May 23, 2012 (JP) ..... 2012-117121

(51) Int. Cl.
*G03G 15/08* (2006.01)
*G03G 21/16* (2006.01)

(52) U.S. Cl.
CPC ..... *G03G 15/0839* (2013.01); *G03G 15/0886* (2013.01); *G03G 21/1647* (2013.01); *G03G 21/1676* (2013.01); *G03G 2221/1657* (2013.01);

(Continued)

(58) Field of Classification Search
CPC ..... G03G 15/0832; G03G 15/0839; G03G 2215/067; G03G 2215/0177; G03G 2215/0692; G03G 15/0834; G03G 21/1676; G03G 21/1647; G03G 15/0837; G03G 15/0896; G03G 2215/0665; G03G 2215/0668; G03G 2215/0675
USPC ..... 399/262, 260, 258, 120, 263, 119, 227, 399/27, 110, 13
See application file for complete search history.

(56) References Cited

U.S. PATENT DOCUMENTS 6,615,008 B2 9/2003 Higeta et al.
2002/0034398 A1 3/2002 Higeta et al.
2004/0131391 A1* 7/2004 Nagashiro ..... 399/258

(Continued)

FOREIGN PATENT DOCUMENTS

JP S63-5490 U 1/1988
JP H06-130745 A 5/1994

(Continued)

OTHER PUBLICATIONS

An Office Action; "Notice of Reason for Rejection," issued by the Japanese Patent Office on Jun. 3, 2014, which corresponds to Japanese Patent Application No. 2012-117121 and is related to U.S. Appl. No. 13/897,211.

*Primary Examiner* — Roy Y Yi
(74) *Attorney, Agent, or Firm* — Studebaker & Brackett PC

(57) ABSTRACT

A toner case includes a case main body and a shutter, a lever, a rotating member and a transmitting member attached to the case main body. The case main body includes a discharge port discharging a toner. The shutter is rotatably attached to open/close the discharge port and includes a shutter side gear. The lever is rotatably attached to operate the shutter and includes a lever main body that includes a lever side gear meshing with the shutter side gear. The rotating member is installed in a rotatable state. The transmitting member is rotatably attached to transmit the rotation to the rotating member and includes a transmitting member main body that covers the outside of the lever main body and includes an aperture. The aperture exposes a meshing part of the lever side gear and shutter side gear when the transmitting member is located to a predetermined rotational displacement.

12 Claims, 9 Drawing Sheets

(52) U.S. Cl.
CPC ..... *G03G 15/0891* (2013.01); *G03G 15/0877* (2013.01)

(56) References Cited

U.S. PATENT DOCUMENTS

| | | | | |
|---|---|---|---|---|
| 2007/0077101 | A1* | 4/2007 | Tamura et al. | 399/262 |
| 2010/0129119 | A1 | 5/2010 | Nagashima et al. | |
| 2013/0195511 | A1* | 8/2013 | Eto | 399/260 |
| 2013/0279943 | A1* | 10/2013 | Wakimoto | 399/262 |

FOREIGN PATENT DOCUMENTS

| | | | |
|---|---|---|---|
| JP | H08-305250 | A | 11/1996 |
| JP | 2002-014594 | A | 1/2002 |
| JP | 2005-181885 | A | 7/2005 |
| JP | 2007-316113 | A | 12/2007 |
| JP | 2008-116479 | A | 5/2008 |
| JP | 2009-168857 | A | 7/2009 |
| JP | 2010-096827 | A | 4/2010 |

* cited by examiner

TONER CASE AND IMAGE FORMING APPARATUS

INCORPORATION BY REFERENCE

This application is based on and claims the benefit of priority from Japanese Patent application No. 2012-117121 filed on May 23, 2012, the entire contents of which are incorporated herein by reference.

BACKGROUND

The present disclosure relates to a toner case and an image forming apparatus provided with the toner case.

An electrographic image forming apparatus carries out the development process by supplying a toner (a developer) from a development device to an electrostatic latent image formed on the surface of a photosensitive drum or the like. The toner used in such development process is supplied from a toner case, such as a toner container or an intermediate hopper, to the development device. The toner case comprises a case main body containing the toner and the case main body is provided with a discharge port discharging the toner to the development device.

This discharge port is generally covered by a shutter. For instance, the rotational shutter configured to open/close the discharge port inward is disclosed. This shutter is connected with a lever rotatably attached to the case main body via a gear so that the shutter turns accompanying to a turn of the lever.

Inside the case main body, a rotating member is installed. The rotating member is connected with a transmitting member located outside the lever so that the rotating member rotates accompanying to a rotation of the transmitting member.

However, the transmitting member covers a meshing part of a lever side gear and a shutter side gear. Consequently, after the transmitting member is attached to the case main body, it is difficult to confirm that the lever side gear and shutter side gear are meshed together at a suitable position. Therefore, there is a fear that an assembling work of the toner case is finished with an unsuitable meshing position of the lever side gear and shutter side gear, thereby causing malfunction or the like of the shutter.

SUMMARY

In accordance with an embodiment of the present disclosure, a toner case includes a case main body, a shutter, a lever, a rotating member and a transmitting member. The case main body includes a discharge port configured to discharge a toner. The shutter is rotatably attached to the case main body to open/close the discharge port and configured to include a shutter side gear. The lever is rotatably attached to the case main body to operate the shutter and configured to include a lever main body having a lever side gear meshing with the shutter side gear. The rotating member is installed in the case main body in a rotatable state. The transmitting member is rotatably attached to the case main body to transmit the rotation to the rotating member. The transmitting member further includes a transmitting member main body covering the outside of the lever main body. The transmitting member main body includes an aperture. The aperture is configured to expose a meshing part of the lever side gear and shutter side gear in a situation in which the transmitting member is located to a predetermined rotational displacement.

Furthermore, in accordance with an embodiment of the present disclosure, an image forming apparatus includes a toner case. The toner case includes a case main body, a shutter, a lever, a rotating member and a transmitting member. The case main body includes a discharge port configured to discharge a toner. The shutter is rotatably attached to the case main body to open/close the discharge port and configured to include a shutter side gear. The lever is rotatably attached to the case main body to operate the shutter and configured to include a lever main body having a lever side gear meshing with the shutter side gear. The rotating member is installed in the case main body in a rotatable state. The transmitting member is rotatably attached to the case main body to transmit the rotation to the rotating member. The transmitting member further includes a transmitting member main body covering the outside of the lever main body. The transmitting member main body includes an aperture. The aperture is configured to expose a meshing part of the lever side gear and shutter side gear in a situation in which the transmitting member is located to a predetermined rotational displacement.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
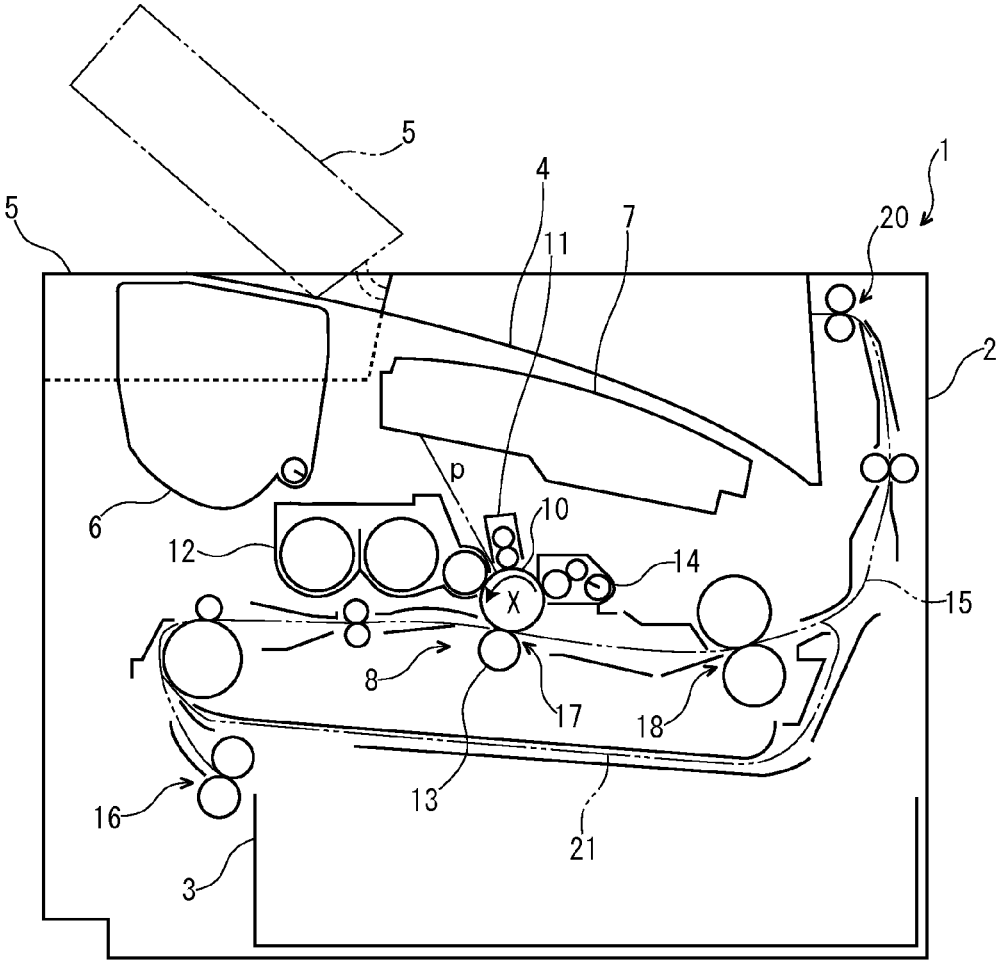
FIG. 1 is a schematic diagram schematically showing a printer according to an embodiment of the present disclosure.

With reference to FIG. 1, the entire structure of an electrographic printer (an image forming apparatus) 1 will be described. FIG. 1 is a schematic diagram schematically showing the printer according to an embodiment of the present disclosure. Hereinafter, it will be described so that the front side of the printer 1 is positioned at the left-hand side of FIG. 1.

The printer 1 includes a box-formed printer main body 2. In a lower part of the printer main body 2, a sheet feeding cartridge 3 configured to store sheets (not shown) is installed and, on the top surface of the printer main body 2, an ejecting tray 4 is mounted. On the top surface of the printer main body 2, an upper cover 5 is openably/closably attached in front of the sheet ejecting tray 4 and, below the upper cover 5, a toner container 6 as a toner case is installed.

In an upper part of the printer main body 2, an exposure device 7 composed of a laser scanning unit (LSU) is installed below the sheet ejecting tray 4. Below the exposure device 7, an image forming unit 8 is installed. In the image forming unit 8, a photosensitive drum 10 as an image carrier is rotatably installed. Around the photosensitive drum 10, a charger 11, a development device 12, a transfer roller 13 and a cleaning device 14 are located along a rotating direction (refer to arrow X in FIG. 1) of the photosensitive drum 10. To the development device 12, the toner container 6 is attachably/detachably installed. For instance, when a toner (a developer) is exhausted, the toner container 6 can be replaced by opening the upper cover 5 (refer to two-dot chain line in FIG. 1).

Inside the printer main body 2, a sheet conveying path 15 is arranged. At an upper stream end of the conveying path 15, a sheet feeder 16 is positioned. At an intermediate stream part of the conveying path 15, a transferring unit 17 constructed of the photosensitive drum 10 and transfer roller 13 is positioned. At a lower stream part of the conveying path 15, a fixing device 18 is positioned. At a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with the toner in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing device 18, and then, the toner image is fixed on the sheet in the fixing device 18. The sheet with the fixed toner image is ejected from the sheet ejecting unit 20 to the sheet ejecting tray 4. Toner remained on the photosensitive drum 10 is collected by the cleaning device 14.

Figure 2:
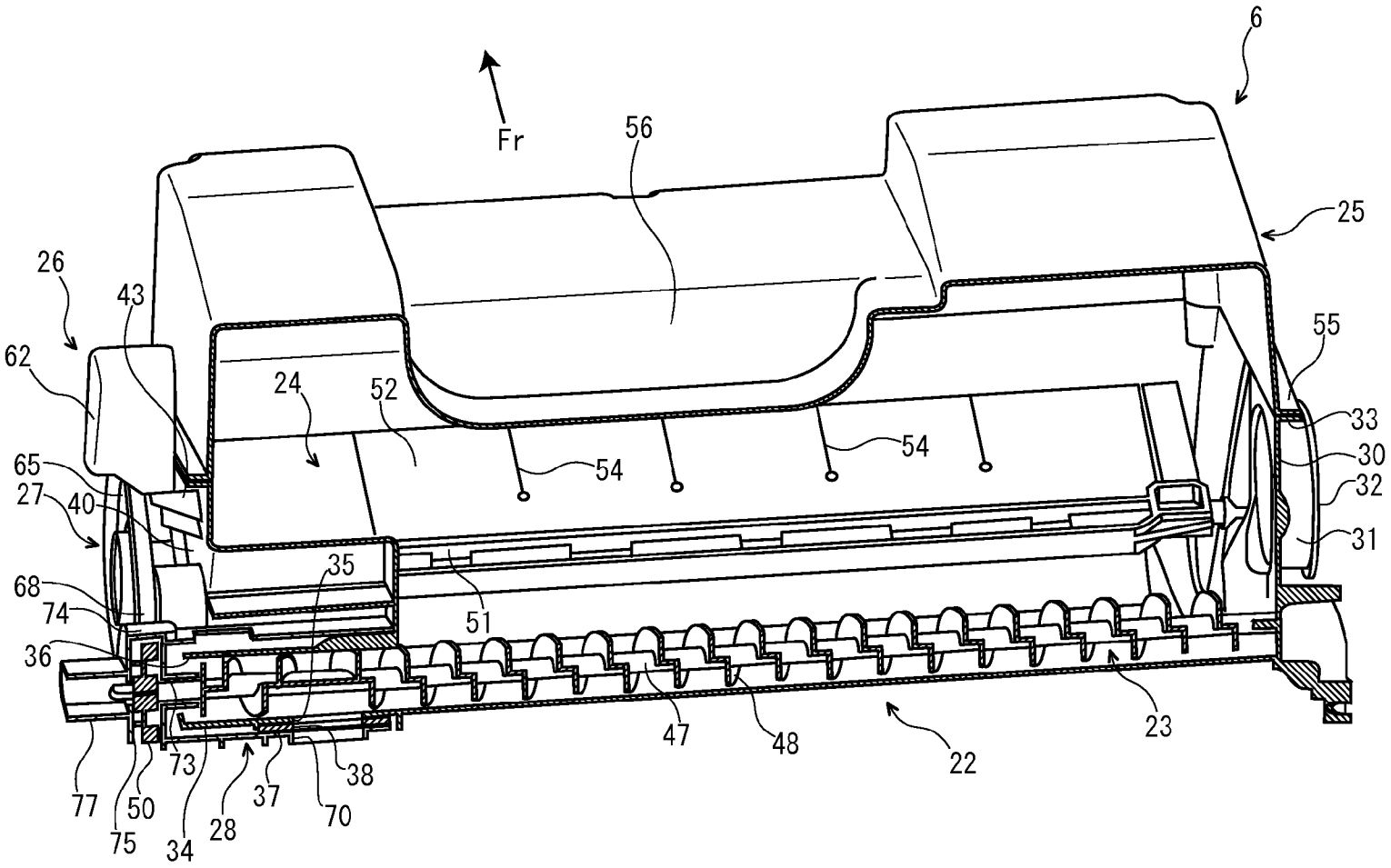
FIG. 2 is a back perspective sectional view showing a toner container in the printer according to the embodiment of the present disclosure.
Figure 3:
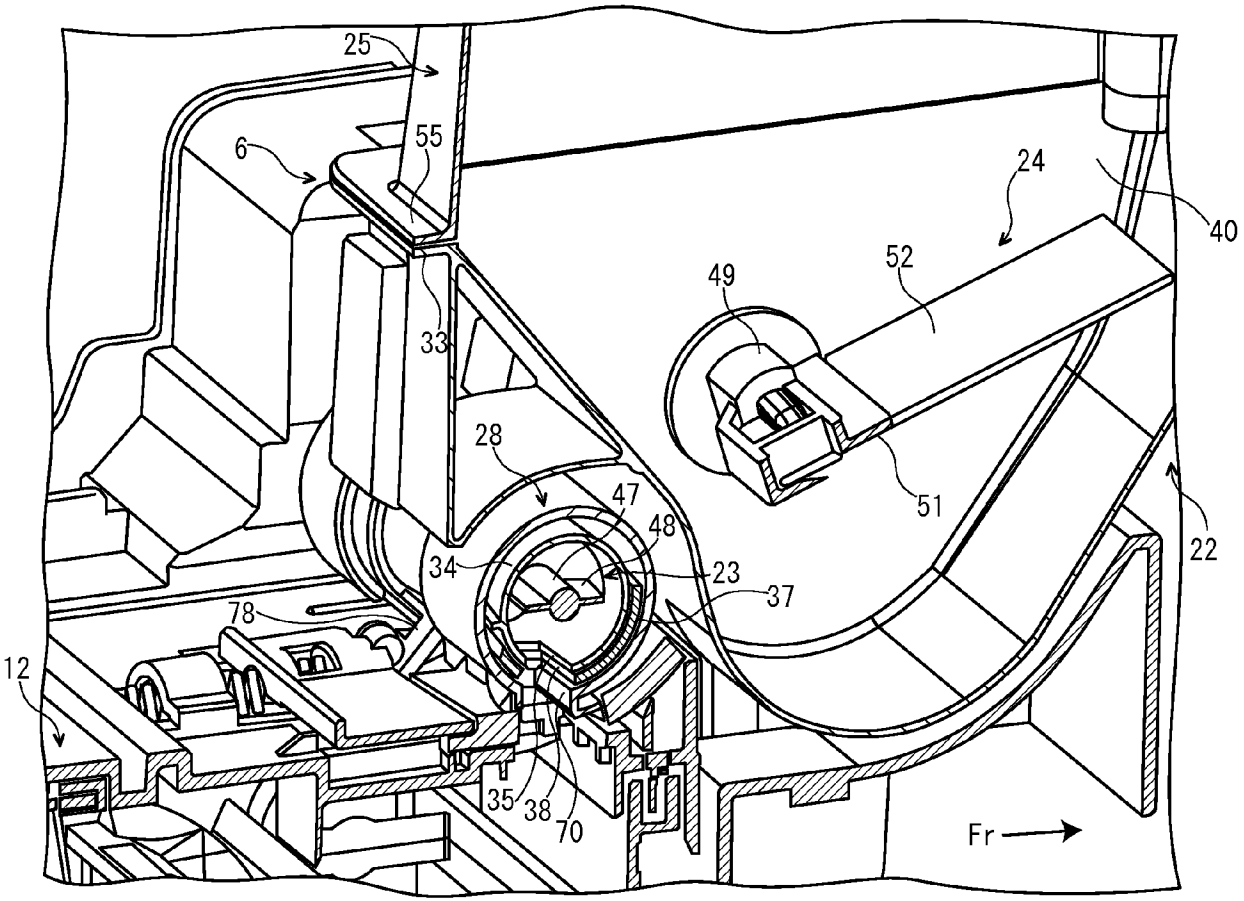
FIG. 3 is a back left perspective sectional view showing the toner container of the printer in a situation, in which a shutter opens a discharge port, according to the embodiment of the present disclosure.
Figure 4:
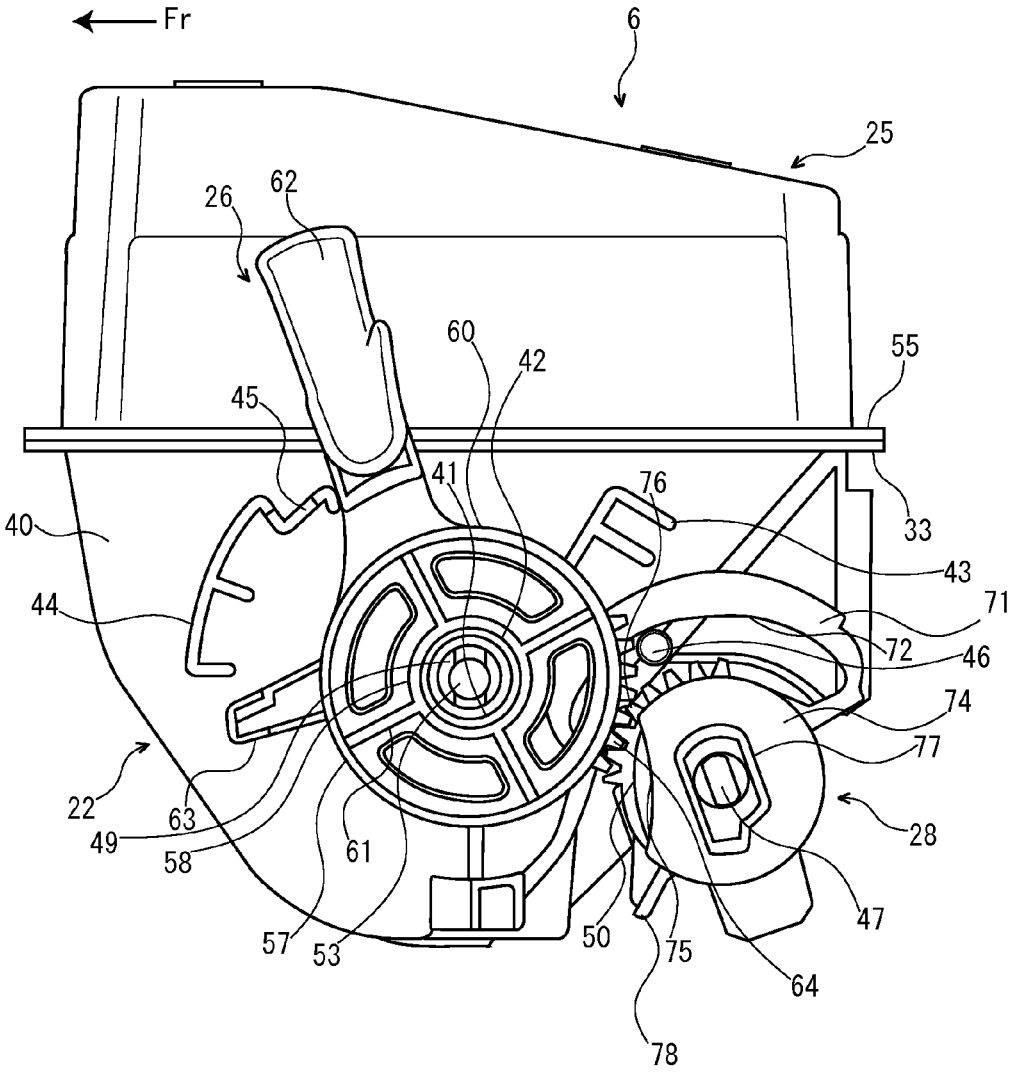
FIG. 4 is a right side view showing the toner container in the printer according to the embodiment of the present disclosure.
Figure 5:
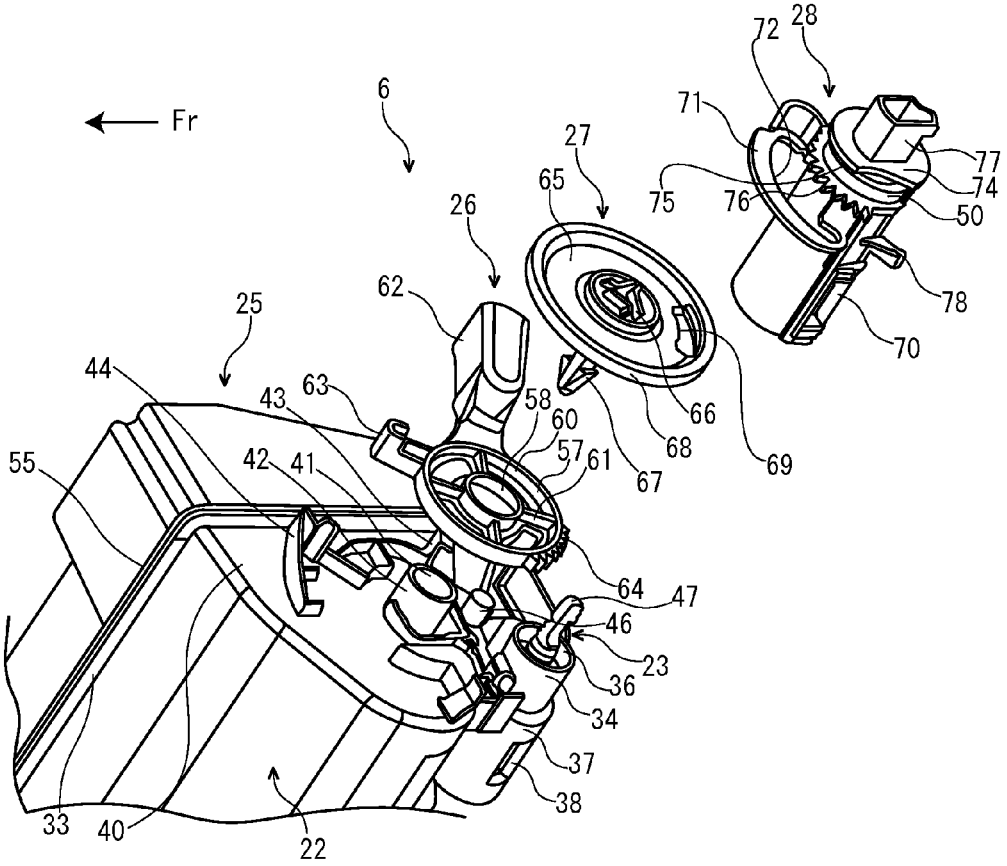
FIG. 5 is an exploded perspective view showing the toner container in the printer according to the embodiment of the present disclosure.
Figure 6:
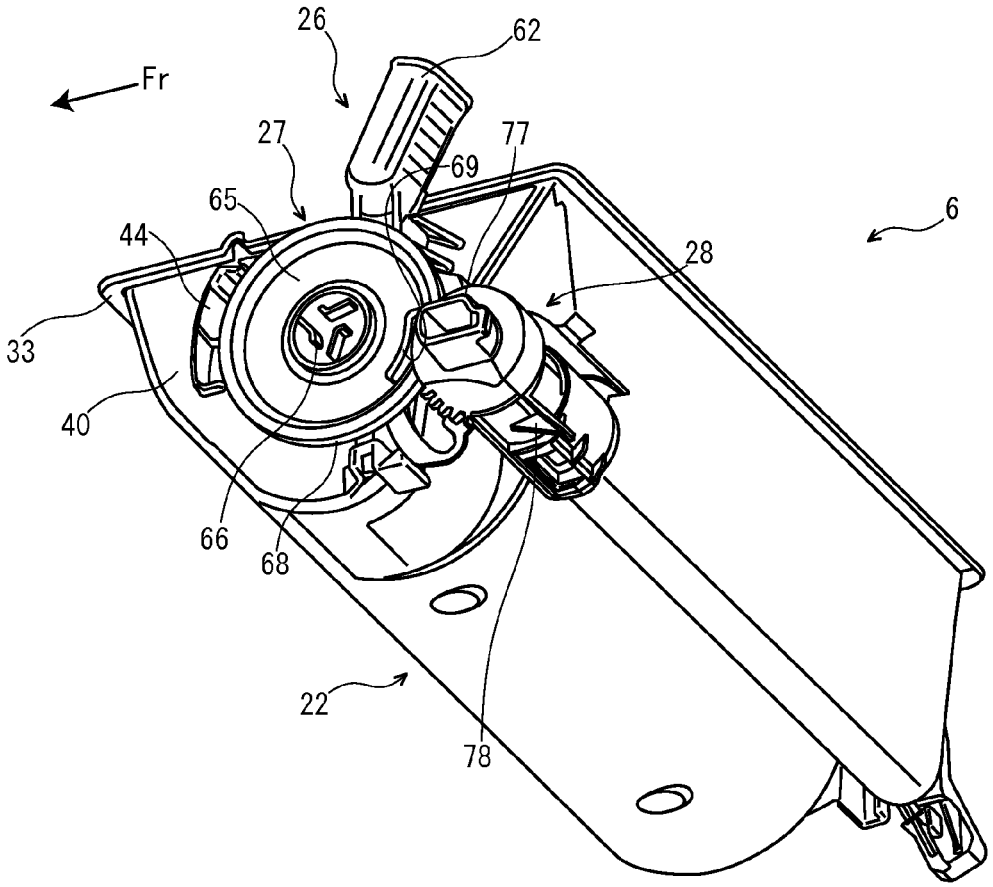
FIG. 6 is a right bottom perspective view showing the toner container in the printer according to the embodiment of the present disclosure.

Next, with reference to FIGS. 2-6, the toner container 6 will be described in detail. FIG. 2 is a back perspective sectional view showing the toner container in the printer according to the embodiment of the present disclosure. FIG. 3 is a back left perspective sectional view showing the toner container of the printer in a situation, in which a shutter opens a discharge port, according to the embodiment of the present disclosure. FIG. 4 is a right side view showing the toner container in the printer according to the embodiment of the present disclosure. FIG. 5 is an exploded perspective view showing the toner container in the printer according to the embodiment of the present disclosure. FIG. 6 is a right bottom perspective view showing the toner container in the printer according to the embodiment of the present disclosure.

Arrow Fr suitably put on each figure indicates the front side of the printer 1. Because FIG. 2 is the back perspective sectional view, the left-hand and right-hand sides of the figure are converse to the actual left-hand and right-hand sides. That is, the right-hand side illustrated in FIG. 2 is the left-hand side of the toner container 6 and the left-hand side illustrated in FIG. 2 is the right-hand side of the toner container 6.

As shown in FIG. 2 and other figure, the toner container 6 includes a box-formed case main body 22 with a opened top surface, a conveying screw 23 as a rotating member, a stirring paddle 24 as another rotating member, a covering body 25, a lever 26, a transmitting member 27 and a shutter 28. The conveying screw 23 is installed in a lower rear part of the case main body 22. The stirring paddle 24 is installed near a center part of the case main body 22. The covering body 25 covers the top surface of the case main body 22. The lever 26 is attached to a right end of the case main body 22. The transmitting member 27 is placed on the right end of the case main body 22 together with the lever 26. The shutter 28 is attached on a right bottom end of the case main body 22. The covering body 25 is omitted in FIGS. 6 and 9 and the transmitting member 27 is omitted in FIG. 4.

The case main body 22 is formed in an extended-shape in left and right directions or a horizontal direction to contain the toner. As shown in FIG. 2, on a left end wall 30 of the case main body 22, a toner filling port 31 is formed and the toner filling port 31 is closed by a cap 32. On the circumference of a top end of the case main body 22, a main body side flange 33 is formed.

At the right bottom end of the case main body 22, a cylinder-formed discharge duct 34 is protruded to a right direction and, in a right end of the discharge duct 34, a right end aperture 36 is formed. As shown in FIG. 3 and other figure, in a bottom of the discharge duct 34, a discharge port 35 discharging the toner is bored. On the circumference of a lower part of the discharge duct 34, a sealing member 37 is attached and, in the sealing member 37, a communication port 38 is bored at a correspondent position to the discharge port 35.

As shown in FIG. 4, at the center of a right end wall 40 of the case main body 22, a cylinder-formed boss 42 having a communication hole 41 is protruded to a right direction (an outside direction). On a right surface (an external surface) of the right end wall 40 of the case main body 22, a first restrain rib 43 is protruded to an upper backward direction of the boss 42. On the right surface of the right end wall 40 of the case main body 22, a second restrain rib 44 is protruded to an upper forward direction of the boss 42. In an upper part of the second restrain rib 44, a depression 45 is formed. On the right surface of the right end wall 40 of the case main body 22, a columnar protrusion 46 is formed below the first restrain rib 43.

As shown in FIG. 2 and other figure, the conveying screw 23 is formed in an extended-shape in the horizontal direction and installed in the case main body 22 in a rotatable state. The conveying screw 23 includes a bar-formed rotating shaft and a spiral fin 48 concentrically mounted on the circumference of the rotating shaft 47. A left end of the rotating shaft 47 is pivotally supported by the left end wall 30 of the case main body 22. Right side parts of the rotating shaft 47 and spiral fin 48 are inserted into the discharge duct 34. A right end of the rotating shaft 47 protrudes from the discharge duct 34 via the right end aperture 36 to the right direction and, on the protruding part, a conveying gear 50 is fixedly attached.

The stirring paddle 24 is located above and in front of the conveying screw 23 and formed in an extended-shape in the horizontal direction. The stirring paddle 24 is installed in the case main body 22 in a rotatable state. The stirring paddle 24 includes a supporting frame 51 as a supporting member and a sheet-formed stirring fin 52 supported by the supporting frame 51. Left and right ends (both horizontal ends) of the supporting frame 51 are pivotally supported by the left end wall 30 and right end wall 40 of the case main body 22 via respective bearings 49 (refer to FIG. 3). Hereinafter, the bearing 49 is called as "a bearing 49 of a stirring paddle 24". As shown in FIG. 4, on the bearing 49 of the stirring paddle 24 attached onto the right end wall 40, an engaging reception 53 is formed at a correspondent position to the communication hole 41 of the boss 42.

The stirring fin 52 is formed out of plastic sheet, e.g. lumirror. As shown in FIG. 2 and other figure, one side of the stirring fin 52 is fixedly attached onto the supporting frame 51 along the horizontal direction. The stirring fin 52 is provided with a plurality of slits 54. The stirring fin 52 is configured to rotate with the supporting frame 51 accompanying to a rotation of the stirring paddle 24, and then, to contact with/separate from the internal surface of the case main body 22.

On a bottom end of the covering body 25, a covering body side flange 55 is formed in the correspondent form to the main body side flange 33 of the case main body 22. The main body side flange 33 and covering body side flange 55 are ultrasonic-welded together so that the case main body 22 and covering body 25 are unified. In a center of the horizontal direction of the covering body 25, a hollow 56 is formed.

As shown in FIG. 4, the lever 26 includes a lever main body 57 with a circular profile in aside view. The lever main body 57 includes a small-diameter cylinder 58, a large-diameter cylinder 60 attached around the circumference of the small-diameter cylinder 58 and four radially extended connecters 61 connecting the small-diameter cylinder 58 and large-diameter cylinder 60 with each other. The small-diameter cylinder 58 is fitted onto the circumference of the boss 42 arranged on the right end wall 40 of the case main body 22. Accordingly, the lever 26 is rotatably supported onto the case main body 22.

On an upper part of the large-diameter cylinder 60, a gripper 62 is protruded to the outside in the radial direction. A top end of the gripper 62 extends to the right side of the covering body 25. On a front part of the large-diameter cylinder 60, a protruding piece 63 is formed. On the circumference of a lower rear part of the large-diameter cylinder 60, a lever side gear 64 is formed.

As shown in FIG. 5, the transmitting member 27 includes a disc-formed transmitting member main body 65. The transmitting member main body 65 is configured to cover the outside of the lever main body 57 (refer to FIG. 6). On a right surface (an external surface) of the transmitting member main body 65, a transmission coupling 66 is protruded.

As shown in FIG. 5, on a left surface (an internal surface) of the transmitting member main body 65, an engaging piece 67 is protruded. The engaging piece 67 is inserted into the communication hole 41 bored in the boss 42 of the case main body 22, and then, engaged with the engaging reception 53 (refer to FIG. 4 and other figure) formed on the bearing 49 of the stirring paddle 24. Accordingly, the transmitting member 27 and supporting frame 51 of the stirring paddle 24 are connected with each other without relative rotation so that the transmitting member 27 and stirring paddle 24 rotates in a body on the case main body 22. On the circumference of the transmitting member main body 65, a transmission gear 68 is formed. The transmission gear 68 meshes with the conveying gear 50 of the conveying screw 23. In the outside part of the transmitting member main body 65 in the radial direction, an aperture 69 is bored. The aperture 69 is curved in an arc-liked shape along the circumference of the transmitting member main body 65.

The shutter 28 is formed in a roughly cylinder-liked shape and rotatably fitted onto the circumference of the discharge duct 34 of the case main body 22. In a lower surface of the shutter 28, a discharge aperture 70 is bored. As shown in FIG. 3 and other figure, the discharge aperture 70 is formed at a correspondent position to the discharge port 35 of the case main body 22 and the communication port 38 of the sealing member 37.

As shown in FIG. 4, on the shutter 28, a roughly fan-formed guiding piece 71 is protruded to the outside in the radial direction. In the guiding piece 71, an arc-formed guiding hole 72 is formed and, with the guiding hole 72, the protrusion 46 of the case main body 22 is engaged.

As shown in FIG. 2 and other figure, in the shutter 28, a cylinder-formed bearing 73 is formed and, into the bearing 73, the right end of the rotating shaft 47 of conveying screw 23 is pivotally supported. On the right side of the bearing 73, a gear box 74 is attached and the gear box 74 houses the conveying gear 50. As shown in FIG. 5 and other figure, in the gear box 74, a communication aperture 75 is formed so that the conveying gear 50 can be housed in the gear box 74 via the communication aperture 75.

The shutter 28 is provided with a shutter side gear 76. The shutter side gear 76 meshes with the lever side gear 64 of the lever 26. Thereby, the lever 26 and shutter 28 are connected with each other so that the shutter 28 turns in the opposite direction to the lever 26 accompanying to the turn of the lever 26. That is, it is possible to operate the shutter 28 by the lever 26. On the right end of the shutter 28, an elliptic locking piece 77 is attached. In a lower part of the shutter 28, a pressing protrusion 78 is formed at the right side of the discharge aperture 70.

Figure 7A:
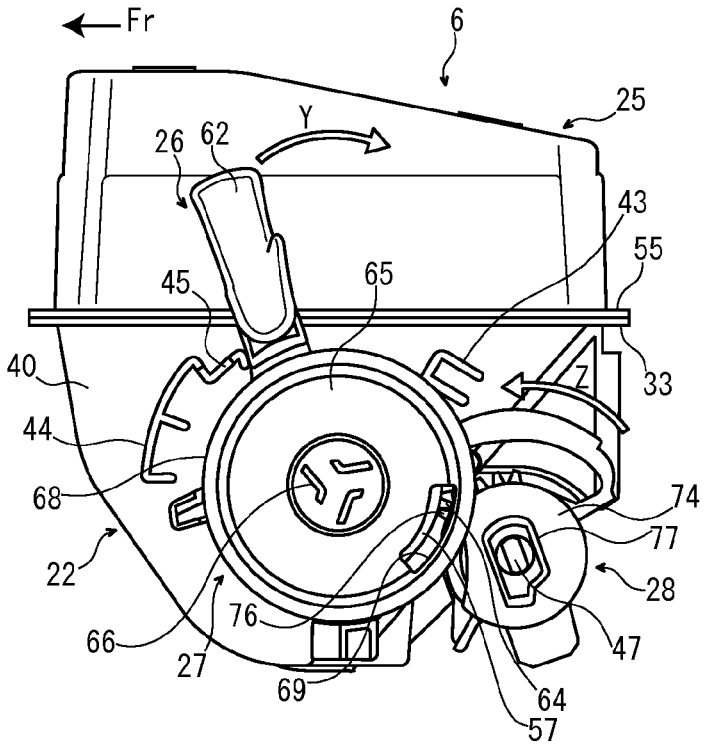
FIG. 7A is a right side view showing the printer in a situation, in which a gripper of a lever is tilted forward, according to the embodiment of the present disclosure
Figure 8:
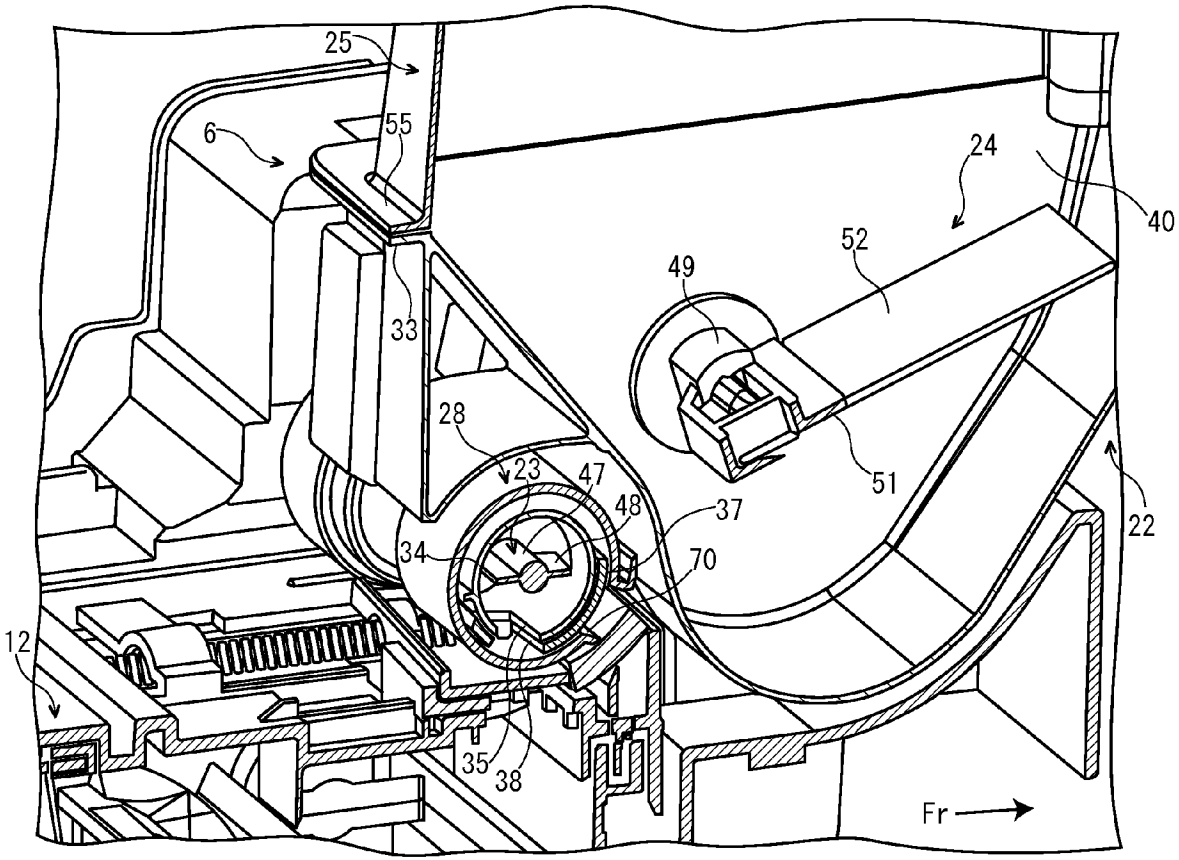
FIG. 8 is a back left perspective sectional view showing the toner container of the printer in a situation, in which the shutter closes the discharge port, according to the embodiment of the present disclosure.

In the above-mentioned structure, a method of supplying the toner from the toner container 6 to the development device 12 will be described. As shown in FIG. 7A, the toner container 6 is installed to the development device 12 in a situation in which the gripper 62 of the lever 26 is tilted forward. At this moment, as shown in FIG. 8, positions of the discharge port 35 of the case main body 22 and discharge aperture 70 of the shutter 28 are not accordant with each other. That is, the shutter 28 closes the discharge port 35 of the case main body 22.

Figure 7B:
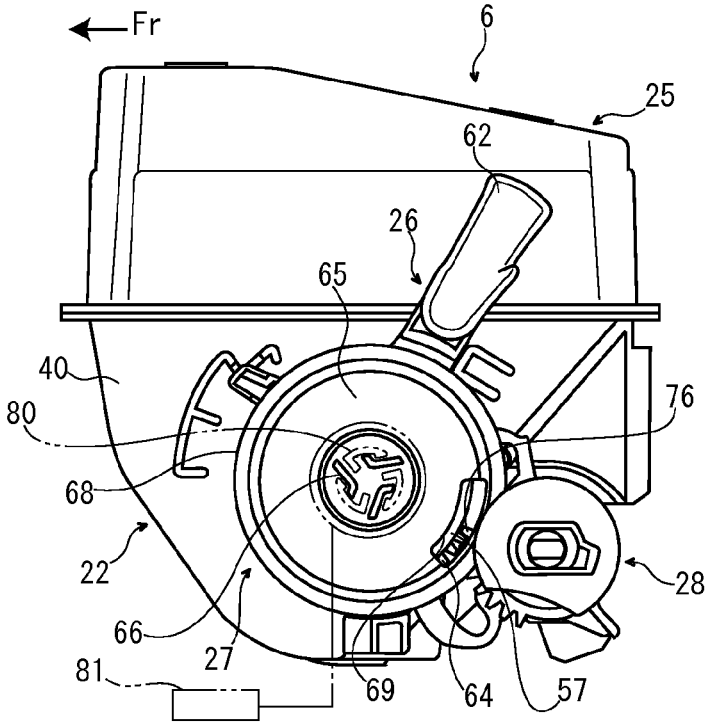
FIG. 7B is a right side view showing the printer in a situation, in which the gripper of the lever is tilted backward, according to the embodiment of the present disclosure.

Subsequently to this situation, when, as indicated by arrow Y in FIG. 7A, a worker, such as a user or a serviceman, tilts the gripper 62 of the lever 26 backward, the lever 26 turns in one direction (a clockwise direction in the figure) (refer to FIG. 7B). Accompanying to this turn, as indicated by arrow Z in FIG. 7A, the shutter 28 connected with the lever 26 turns in another direction (a counter clockwise direction in the figure) on the case main body 22 (refer to FIG. 7B). By the latter turn of the shutter 28, as shown in FIG. 3, the positions of the discharge port 35 of the case main body 22 and discharge aperture 70 of the shutter 28 accord with each other. That is, the shutter 28 opens the discharge port 35 of the case main body 22. Thereby, the inside of the case main body 22 communicates with the inside of the development device 12.

In addition, accompanying to the above-mentioned turn of the lever 26, a drive coupling 80 (refer to FIG. 7B) mounted on the development device 12 is jointed to the transmission coupling 66. In such a situation, when a driver 81, such a motor, connected with the drive coupling 80 rotates, this rotation is transmitted to the transmitting member 27, and then, the transmitting member 27 rotates. When the transmitting member 27 thus rotates, this rotation is transmitted to the stirring paddle 24, and then, the stirring paddle 24 rotates. Thereby, the toner in the case main body 22 is stirred and conveyed to the conveying screw 23.

Moreover, when the transmitting member 27 rotates as mentioned above, this rotation is transmitted to the conveying screw 23, and then, the conveying screw 23 rotates. Accordingly, the toner in the case main body 22 is discharged from the discharge port 35 and filled into the development device 12.

Next, in the above-mentioned structure, a procedure of attaching the lever 26, transmitting member 27 and shutter 28 to the case main body 22 will be described.

First, the small-diameter cylinder 58 of the lever 26 is attached onto the circumference of the boss 42 of the case main body 22 and the shutter 28 is attached onto the circumference of the discharge duct 34 of the case main body 22. At this moment, the lever side gear 64 of the lever 26 and the shutter side gear 76 of the shutter 28 are not made meshed with each other, but kept in a free state.

Figure 9:
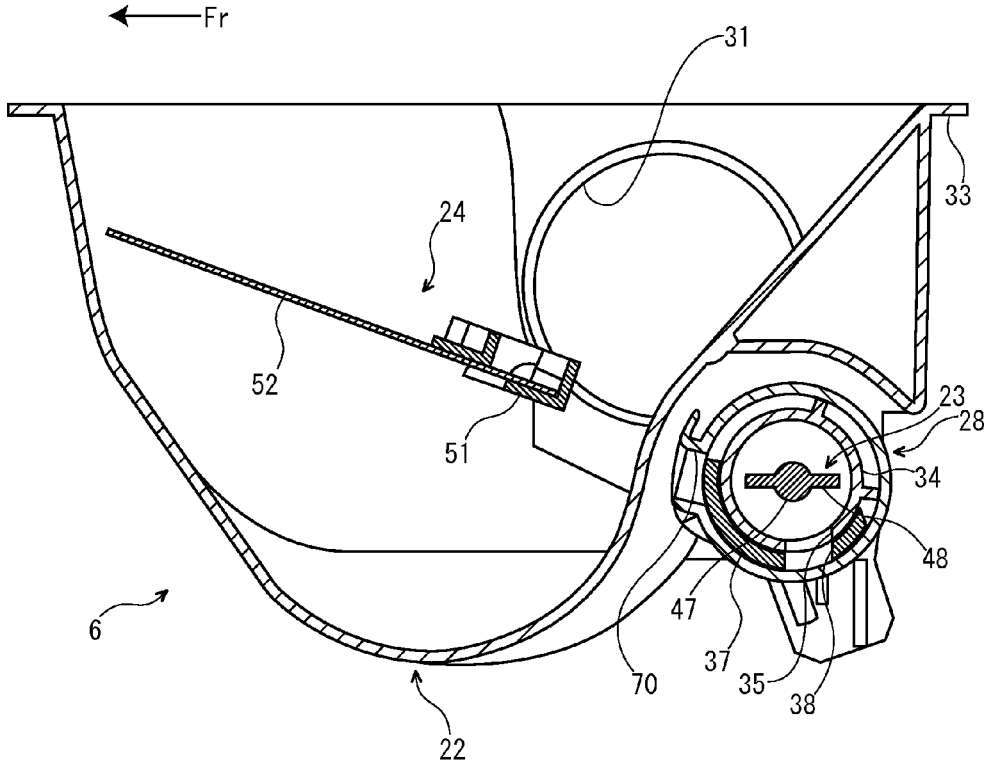
FIG. 9 is a sectional view showing a stirring paddle in the toner container of the printer, when a transmitting member is located at a predetermined rotational displacement, according to the embodiment of the present disclosure.

Then, the engaging piece 67 (refer to FIG. 5) of the transmitting member 27 is inserted into the communication hole 41 formed in the boss 42 of the case main body 22 and engages with the engaging reception 53 (refer to FIG. 4) formed in the bearing 49 of the stirring paddle 24. Next, as shown in FIG. 7A, the transmitting member 27 is made turned to a predetermined rotational displacement, thereby adjusting the aperture 69 so as to locate at a lower rear part of the transmitting member main body 65. By this adjustment, as shown in FIG. 9, the stirring fin 52 of the stirring paddle 24 becomes a situation of separating from the internal surface of the case main body 22. Thus, it is possible to prevent the stirring fin 52 before use of the toner container 6 from plastic-deforming by contact with the internal surface of the case main body 22.

Subsequently, the gripper 62 of the lever 26 is tilted backward to suitably turn the shutter 28, thereby making the lever side gear 64 and shutter side gear 76 meshed with each other. It is then possible to visually observe, as shown in FIG. 7A, a meshing part of the lever side gear 64 and shutter side gear 76 via the aperture 69 exposing the above-mentioned meshing part. This facilitates confirming the mesh of a tooth in the first column of the lever side gear 64 and a tooth in the first column of the shutter side gear 76 at a suitable position, thereby becoming possible to prevent failure, such as a malfunction, of the shutter 28.

In addition, the structure is adapted to directly transmit the rotation of the transmitting member 27 to the conveying screw 23. It is therefore possible to decrease the number of components in comparison with a case where the transmitting member 27 is connected with the conveying screw 23 via an idle gear or the like, thereby reducing costs.

Moreover, the lever 26, transmitting member 27 and shutter 28 can be attached to the case main body 22 without using screws or the like. It is therefore possible to decrease the number of components and assembling workloads in comparison with a case where the centers of the lever 26, transmitting member 27 and shutter 28 are fastened to the case main body 22 by the screws or the like.

The embodiment was described in case of opening/closing the discharge port 35 of the toner container 6 by the shutter 28 located outside the discharge port 35. However, in another embodiment, the discharge port 35 of the toner container 6 may be opened/closed by the shutter 28 located inside the discharge port 35.

Although ideas of the disclosure are applied to the toner container 6 in the embodiment, as a further embodiment, the ideas of the disclosure may be applied to another toner case (so-called "an intermediate hopper") interposed between the toner container 6 and development device 12.

Although the embodiment was described in a case where ideas of the disclosure are applied to the printer 1, as a furthermore embodiment, the ideas of the disclosure may be applied to another image forming apparatus except the printer 1, such as a copying machine, a facsimile or a multifunction machine.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A toner case comprising:

a case main body including a discharge port configured to discharge a toner;

a shutter rotatably attached to the case main body to open/close the discharge port and configured to include a shutter side gear;

a lever rotatably attached to the case main body to operate the shutter and configured to include a lever main body having a lever side gear meshing with the shutter side gear;

a rotating member installed in the case main body in a rotatable state; and a transmitting member rotatably attached to the case main body to transmit the rotation to the rotating member and configured to include a transmitting member main body covering the outside of the lever main body and having an aperture in the outside part in the radial direction, wherein the aperture is configured, in a situation in which the transmitting member is located to a predetermined rotational displacement, to expose a meshing part of the lever side gear and shutter side gear.

2. The toner case according to claim 1, wherein a stirring paddle as the rotating member includes:

a supporting member connected to the transmitting member; and a stifling fin supported by the supporting member to rotate with the supporting member, and then, to contact with/separate from an internal surface of the case main body, wherein the stifling fin separates from the internal surface of the case main body in the situation in which the transmitting member is located to the predetermined rotational displacement.

3. The toner case according to claim 1, wherein a conveying screw as the rotating member includes:

a rotating shaft including a conveying gear; and a spiral fin mounted on the circumference of the rotating shaft, and on the circumference of the transmitting member main body, a transmission gear meshing with the conveying gear is formed.

4. The toner case according to claim 1, wherein the aperture is configured to curve in an arc-liked shape along the circumference of the transmitting member main body.

5. A toner case comprising:

a case main body including a discharge port configured to discharge a toner;

a shutter rotatably attached to the case main body to open/close the discharge port and configured to include a shutter side gear;

a lever rotatably attached to the case main body to operate the shutter and configured to include a lever main body having a lever side gear meshing with the shutter side gear;

a rotating member installed in the case main body in a rotatable state; and a transmitting member rotatably attached to the case main body to transmit the rotation to the rotating member and configured to include a transmitting member main body covering the outside of the lever main body and having an aperture configured, in a situation in which the transmitting member is located to a predetermined rotational displacement, to expose a meshing part of the lever side gear and shutter side gear, wherein the case main body further includes a communication hole, the rotating member includes an engaging reception at a correspondent position to the communication hole, and on an internal surface of the transmitting member main body, an engaging piece is provided and the engaging piece is configured to insert into the communication hole and to engage with the engaging reception.

6. The toner case according to claim 1, wherein, on an external surface of the transmitting member main body, a transmission coupling is provided, and accompanying to a rotation of the lever, a drive coupling connected with a driver is jointed to the transmission coupling.

7. An image forming apparatus comprising a toner case configured to include:

a case main body including a discharge port configured to discharge a toner;

a shutter rotatably attached to the case main body to open/close the discharge port and configured to include a shutter side gear;

a lever rotatably attached to the case main body to operate the shutter and configured to include a lever main body having a lever side gear meshing with the shutter side gear;

a rotating member installed in the case main body in a rotatable state; and a transmitting member rotatably attached to the case main body to transmit the rotation to the rotating member and configured to include a transmitting member main body covering the outside of the lever main body and having an aperture in the outside part in the radial direction, wherein the aperture is configured, in a situation in which the transmitting member is located to a predetermined rotational displacement, to expose a meshing part of the lever side gear and shutter side gear.

8. The image forming apparatus according to claim 7, wherein a stifling paddle as the rotating member includes:

a supporting member connected to the transmitting member; and a stifling fin supported by the supporting member to rotate with the supporting member, and then, to contact with/separate from an internal surface of the case main body, wherein the stifling fin separates from the internal surface of the case main body in the situation in which the transmitting member is located to the predetermined rotational displacement.

9. The image forming apparatus according to claim 7, wherein a conveying screw as the rotating member includes:

a rotating shaft including a conveying gear; and a spiral fin mounted on the circumference of the rotating shaft, and on the circumference of the transmitting member main body, a transmission gear meshing with the conveying gear is formed.

10. The image forming apparatus according to claim 7, wherein the aperture is configured to curve in an arc-liked shape along the circumference of the transmitting member main body.

11. The image forming apparatus according to claim 7, wherein the case main body further includes a communication hole, the rotating member includes an engaging reception at a correspondent position to the communication hole, and on an internal surface of the transmitting member main body, an engaging piece is provided and the engaging piece is configured to insert into the communication hole and to engage with the engaging reception.

12. The image forming apparatus according to claim 7, further comprising:

a development device, to which the toner case is attachably/detachably installed, configured to include a drive coupling connected with a driver, wherein, on an external surface of the transmitting member main body, a transmission coupling is provided, and accompanying to a rotation of the lever, the drive coupling is jointed to the transmission coupling.

* * * * *